US010314115B2

(12) United States Patent
Cole

(10) Patent No.: US 10,314,115 B2
(45) Date of Patent: Jun. 4, 2019

(54) HEATING TAPE AND VEHICLE HAVING THE SAME

(71) Applicant: DENSO International America, Inc., Southfield, MI (US)

(72) Inventor: Bruce Cole, Blytheville, AR (US)

(73) Assignee: DENSO International America, Inc., Southfield, MI (US)

( * ) Notice: Subject to any disclaimer, the term of this patent is extended or adjusted under 35 U.S.C. 154(b) by 328 days.

(21) Appl. No.: 15/258,391

(22) Filed: Sep. 7, 2016

(65) Prior Publication Data

US 2018/0070412 A1 Mar. 8, 2018

(51) Int. Cl.
*H05B 3/84* (2006.01)
*H05B 3/14* (2006.01)

(52) U.S. Cl.
CPC ..... *H05B 3/84* (2013.01); *H05B 3/141* (2013.01); *H05B 2203/017* (2013.01)

(58) Field of Classification Search
CPC ..... H05B 3/84; H05B 3/141; H05B 3/845; H05B 2203/017; H05B 2203/031; H05B 3/86; H05B 2203/013; H05B 2203/002; H05B 2203/003; H05B 2203/004; H05B 2203/005; H05B 2214/02
See application file for complete search history.

(56) References Cited

U.S. PATENT DOCUMENTS

| | | | | |
|---|---|---|---|---|
| 3,380,867 A | | 4/1968 | Morey | |
| 3,736,404 A | * | 5/1973 | Eisler | H05B 3/84 174/117 A |
| 4,823,106 A | | 4/1989 | Lovell | |
| 2014/0076877 A1 | | 3/2014 | Cheng | |

FOREIGN PATENT DOCUMENTS

JP 2000-357579 A 12/2000

* cited by examiner

*Primary Examiner* — Shawntina T Fuqua

(57) ABSTRACT

A heating tape for a vehicle includes a base layer, an adhesive layer, and an electrically-resistive layer. The base layer has a strap shape and has optical transparency. The adhesive layer is formed of an adhesive having optical transparency. The adhesive layer is formed on one side of the base layer and is adhesive to a window glass of the vehicle. The electrically-resistive layer is formed of an electrically-resistive material having optical transparency. The electrically-resistive layer generates heat when an electric current passes through the electrically-resistive layer.

14 Claims, 2 Drawing Sheets

HEATING TAPE AND VEHICLE HAVING THE SAME

TECHNICAL FIELD

The present disclosure relates to a heating tape and a vehicle having the same.

BACKGROUND

Typically, vehicles have rear windows with wires that are embedded in window glasses. When defrosting frost or ice formed on the rear window, the embedded wires are configured to generate heat to melt the frost or ice.

However, if there is malfunction in some of the embedded wires in a window glass, the window glass needs to be entirely replaced along with the embedded wires, which may lead an increase in the replacing cost.

In view of the above, it is an objective to provide a heating tape and a vehicle having the same, which can be easily replaced without replacing a window glass.

SUMMARY

This section provides a general summary of the disclosure, and is not a comprehensive disclosure of its full scope or all of its features.

In a first aspect of the present disclosure, a heating tape for a vehicle includes a base layer, an adhesive layer, and an electrically-resistive layer. The base layer has a strap shape and has optical transparency. The adhesive layer is formed of an adhesive having optical transparency. The adhesive layer is formed on one side of the base layer and is adhesive to a window glass of the vehicle. The electrically-resistive layer is formed of an electrically-resistive material having optical transparency. The electrically-resistive layer generates heat when an electric current passes through the electrically-resistive layer.

In a second aspect of the present disclosure, a vehicle includes a window glass and a heating tape. The heating tape is stuck to the window glass. The heating tape includes a base layer, an adhesive layer, and an electrically-resistive layer. The base layer has a strap shape and has optical transparency. The adhesive layer is formed of an adhesive having optical transparency. The adhesive layer is formed on one side of the base layer that faces the window glass and is adhesive to the window glass. The electrically-resistive layer is formed of an electrically-resistive material having optical transparency. The electrically-resistive layer generates heat when an electric current passes through the electrically-resistive layer.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure. In the drawings.

DETAILED DESCRIPTION

Figure 1:
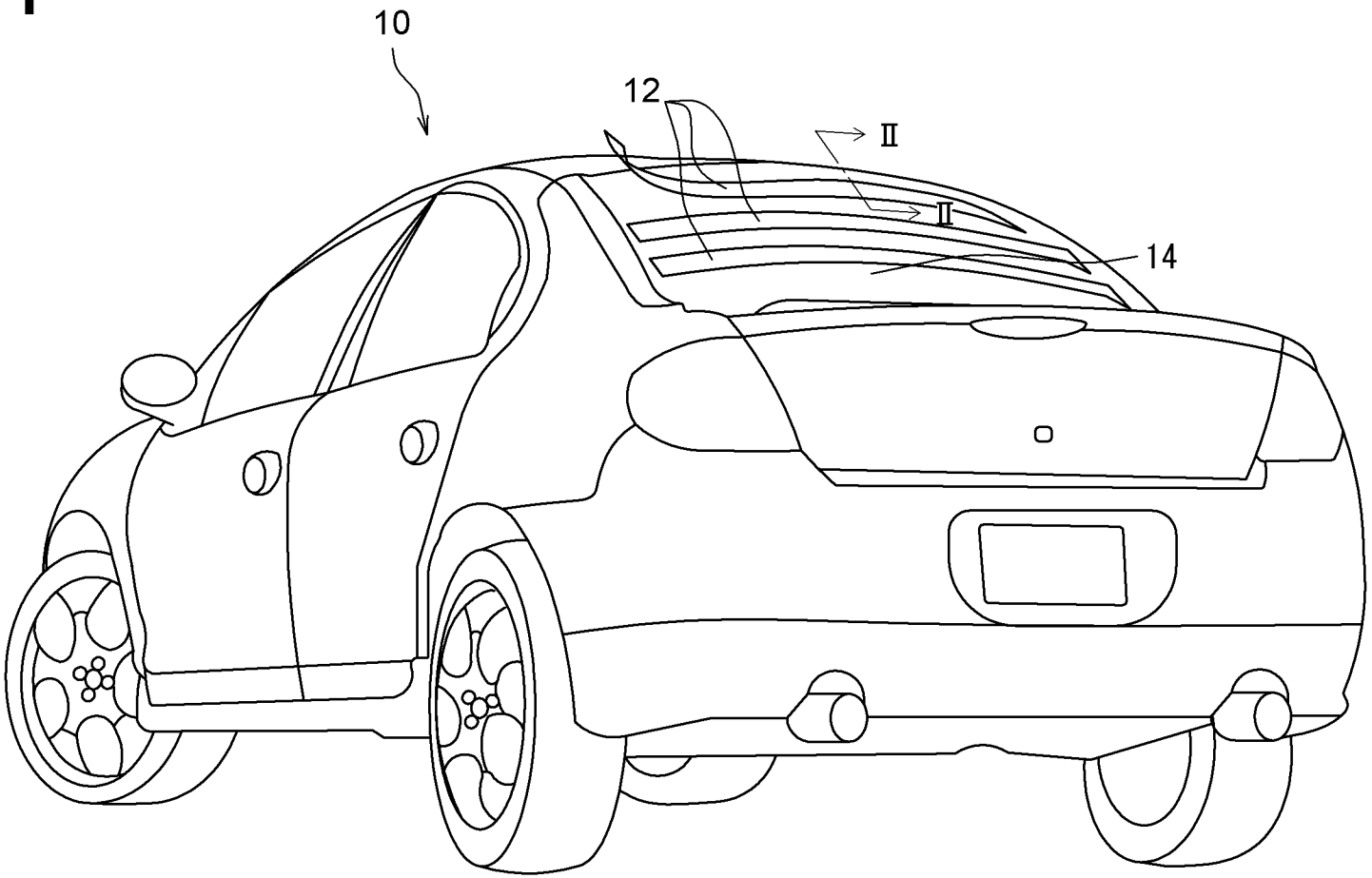
FIG. 1 is a perspective rear view of a vehicle according to a first embodiment.

As follows, a plurality of embodiments of the present disclosure will be described with reference to drawings. It will be apparent to those skilled in the art from this disclosure that the following descriptions of the embodiments are provided for illustration only and not for the purpose of limiting the invention as defined by the appended claims and their equivalents. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts may be combined. The embodiments may be partially combined even if it is not explicitly described that the embodiments may be combined, provided there is no harm in the combination.

First Embodiment

Figure 2:
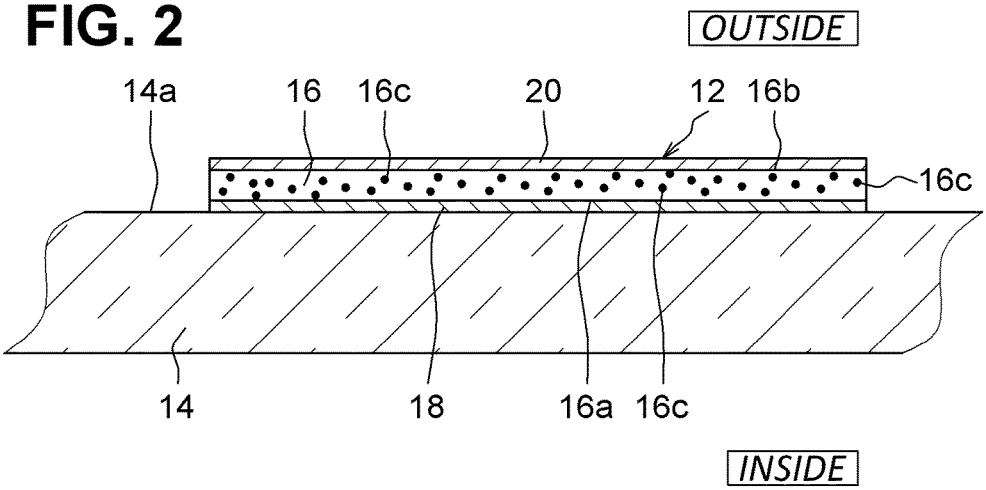
FIG. 2 is a cross-sectional view of a rear window taken along II-II line in FIG. 1.
Figure 3:
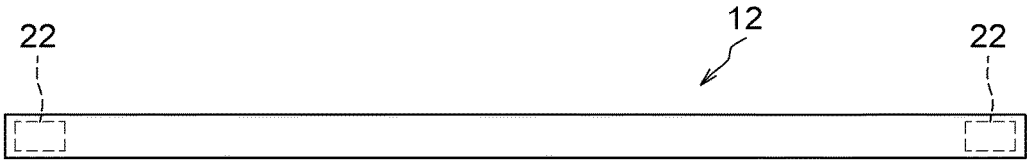
FIG. 3 is a plan view of a heating tape according to the first embodiment.

With reference to FIGS. 1 to 3, a vehicle 10 having heating tapes 12 according to the present embodiment will be described below. In the present embodiment, the heating tapes 12 are applied to a rear window 14 of a regular type of vehicle 10, as shown in FIG. 1. Each of the heating tape 12 generally includes a base layer 16, an adhesive layer 18, and an electrically-resistive layer 20, as shown in FIG. 2. The heating tape 12 further includes connecting terminals 22 at both ends of the heating tape 12, as shown in FIG. 3.

The base layer 16 is formed of a plastic, such as polypropylene, and has optical transparency. The base layer 16 has a strap shape elongated along a lateral direction of the rear window 14. For example, the base layer 16 has substantially the same length as the rear window 14 in the lateral direction. The base layer 16 has a first surface 16*a* that faces the rear window 14 and a second surface 16*b* that is opposite to the first surface 16*a*.

The base layer 16 includes ultra violet inhibitors (UV inhibitors 16*c*). Each of the UV inhibitor 16*c* is made of a UV protective material such as a UV absorber or a UV blocker. The UV inhibitors 16*c* inhibit an ultraviolet radiation from passing through the UV inhibitors 16*c*.

The adhesive layer 18 is formed of an adhesive suitable for glass bonding, such as a polyvinylbutyral adhesive. The adhesive layer 18 has optical transparency. The adhesive layer 18 is formed on the entire of the first surface 16*a* of the base layer 16.

In the present embodiment, the adhesive layer 18 is stuck to an outer surface 14*a* of the rear window 14. The adhesive layer 18 is configured to have grabbing strength (a holding force) to retain the rear window 14. Therefore, when the rear window 14 is broken, the adhesive layer 18 retains the rear window 14 to prohibit the rear window 14 from scattering.

The electrically-resistive layer 20 is formed of an electrically-resistive material such as indium tin oxide. The electrically-resistive layer 20 is formed substantially entirely on the second surface 16*b* of the base layer 16. The electrically-resistive layer 20 is formed to be a very thin film shape by, e.g., cold plasma coating (atmospheric plasma coating) so that the electrically-resistive layer 20 has optical transparency.

The connecting terminals 22 are disposed at both ends of the heating tape 12. The connecting terminals 22 are electrically connected to a power source (not shown), such as a 12V power source mounted to the vehicle 10, through wiring. A voltage is applied to both the connecting terminals 22, when a user manipulates a switching device (not shown) disposed in a dashboard in the vehicle cabin.

Each of the connecting terminals 22 is interposed between the base layer 16 and the electrically-resistive layer 20 so that the electrically-resistive layer 20 is in physically contact with both the connecting terminals 22. Therefore, a voltage is applied to the electrically-resistive layer 20 through the connecting terminals 22 from the power source. An electric current passes through the electrically-resistive layer 20 when the voltage is applied to the electrically-resistive layer 20. The electrically-resistive layer 20 is configured to generate heat when an electric current passes through the electrically-resistive layer 20. More specifically, the electrically-resistive layer 20 is configured to heat to a specified temperature (e.g., 120 degrees Fahrenheit) to melt an ice or frost formed on the rear window 14 but not to degrade the base layer 16 and the adhesive layer 18.

When putting the heating tape 12 on the rear window 14 of the vehicle 10, a user brings the adhesive layer 18 into contact on the outer surface 14*a* of the rear window 14 to have the adhesive layer 18 stuck to the outer surface 14*a* of the rear window 14. For example, three heating tapes 12 may be put on the rear window 14, as shown in FIG. 1. The three heating tapes 12 are arranged to be parallel to each other along the lateral direction of the rear window 14 with substantially constant intervals. In this way, the heating tape 12 can be easily affixed to the rear window 14 without any tool. After affixing the heating tapes 12 to the rear window 14, the connecting terminals 22 of each of the three heating tapes 12 are electrically connected to the power source through wiring.

In a case where frost or ice forms on the rear window 14 under a cold weather condition, a user turns on the switching device to apply a voltage to the heating tapes 12. By applying the voltage to the heating tapes 12, an electric current passes through the electrically-resistive layer 20 of each of the heating tapes 12. Then, the electrically-resistive layer 20 of each of the heating tapes 12 generates heat, and thus the frost or ice formed on the rear window 14 is melted (defrosted). In this case, the electrically-resistive layer 20 is configured to heat to the specified temperature sufficiently to melt frost or ice but not to degrade the base layer 16 and the adhesive layer 18. Thus, neither the base layer 16 nor the adhesive layer 18 would be adversely affected by the heat generated from the electrically-resistive layer 20.

Furthermore, the adhesive layer 18 retains the rear window 14 with a sufficient holding power. Therefore, even if the rear window 14 is broken due to, e.g., a car accident, the heating tape 12 inhibits the rear window 14 from scattering. As a result, occupants in the vehicle 10 can be protected from being injured by scattered glasses.

If one of the heating tapes 12 is damaged, the heating tape 12 can be easily replaced with new one by removing the damaged heating tape 12 from the rear window 14. In other words, only the damaged heating tape 12 can be replaced without replacing the rear window 14. Therefore, the cost for replacing the heating tape 12 can be suppressed as compared to the conventional heating wire, which would need the entire replacement of the rear window 14.

Second Embodiment

Figure 4:
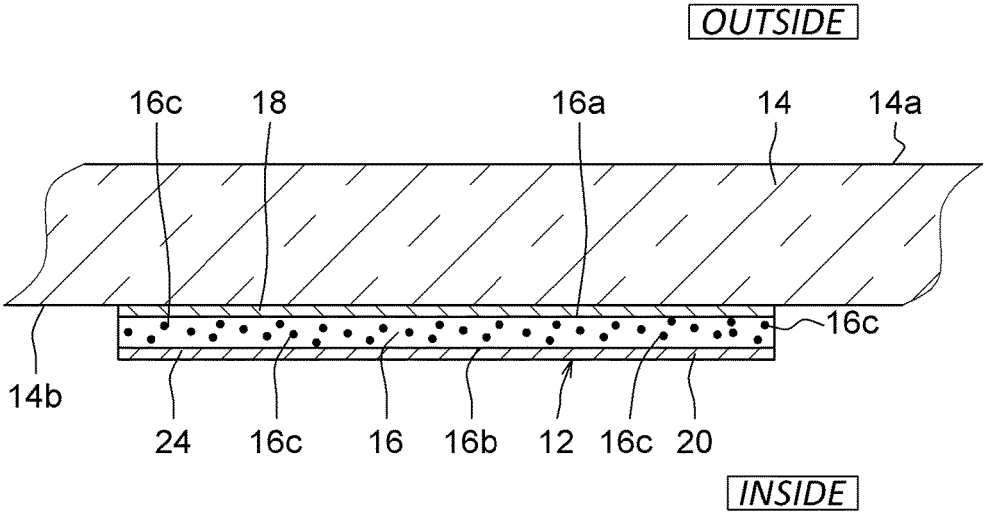
FIG. 4 is a cross-sectional view of a rear window according to a second embodiment.

Next, the heating tape 12 and the vehicle 10 according to the second embodiment will be described with reference to FIG. 4. In the first embodiment, the heating tape 12 is attached to the rear window 14 from an outside of the vehicle 10. On the contrary, in the second embodiment, the heating tape 12 is attached to the rear window 14 from an inside (i.e., from the vehicle cabin) of the vehicle 10.

More specifically, the adhesive layer 18 is stuck to an inner surface 14*b* of the rear window 14. In this way, by attaching the heating tape 12 to the inner surface 14*b* of the rear window 14, the heating tape 12 is not exposed to an outside environment of the vehicle 10. Therefore, the heating tape 12 can be more securely attached to the rear window 14. Furthermore, since the heating tape 12 is not exposed to an outside environment, product life cycle can be elongated as compared to a case where the heating tape 12 is attached to the outer surface 14*a* of the rear window 14.

Other Embodiments

In the above-described embodiments, the heating tape 12 is used for the rear window 14. However, the heating tape 12 can be used for other window glasses, such as side windows or a windshield of the vehicle 10. In the above-described embodiments, the three heating tapes 12 are used, but one or two heating tape 12, or four or more heating tapes 12 can be used.

In the above-described embodiments, the heating tape 12 is used for a regular type of a vehicle. However, the heating tape 12 can be used for any type of vehicle such as a recreational vehicle, a pickup truck, or the like.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed. As used herein, the term "and/or" includes any and all combinations of one or more of the associated listed items.

What is claimed is:

1. A heating tape for a vehicle, the heating tape comprising:

a base layer that has a strap shape, the base layer having optical transparency;

an adhesive layer that is formed of an adhesive having optical transparency, the adhesive layer being formed on one side of the base layer and being adhesive to a window glass of the vehicle; and an electrically-resistive layer that is formed of an electrically-resistive material having optical transparency, wherein the electrically-resistive layer generates heat when an electric current passes through the electrically-resistive layer, wherein the electrically-resistive layer is formed by cold plasma coating.

2. The heating tape according to claim 1, wherein the base layer includes a UV inhibitor that inhibits a ultraviolet radiation from passing therethrough.

3. The heating tape according to claim 1, wherein the electrically-resistive layer is configured to heat to a temperature to melt ice or frost formed on the window glass but not to degrade the base layer and the adhesive layer.

4. The heating tape according to claim 1, wherein the adhesive layer is configured to retain the window glass when the window glass is broken.

5. The heating tape according to claim 1, wherein the window glass includes a rear window of the vehicle, and the heating tape is used for the rear window.

6. The heating tape according to claim 1, wherein the adhesive layer is stuck to an outer surface of the window glass.

7. The heating tape according to claim 1, wherein the adhesive layer is stuck to an inner surface of the window glass.

8. A vehicle comprising:

a window glass; and a heating tape that is stuck to the window glass, wherein the heating tape includes:

a base layer that has a strap shape, the base layer having optical transparency;

an adhesive layer that is formed of an adhesive having optical transparency, the adhesive layer being formed on one side of the base layer that faces the window glass and being adhesive to the window glass; and an electrically-resistive layer that is formed of an electrically-resistive material having optical transparency, wherein the electrically-resistive layer generates heat when an electric current passes through the electrically-resistive layer, wherein the electrically-resistive layer is formed by cold plasma coating.

9. The vehicle according to claim 8, wherein the base layer includes a UV inhibitor that inhibits a ultraviolet radiation from passing therethrough.

10. The vehicle according to claim 8, wherein the electrically-resistive layer is configured to heat to a temperature to melt ice or frost formed on the window glass but not to degrade the base layer and the adhesive layer.

11. The vehicle according to claim 8, wherein the adhesive layer is configured to retain the window glass when the window glass is broken.

12. The vehicle according to claim 8, wherein the window glass includes a rear window of the vehicle, and the heating tape is used for the rear window.

13. The vehicle according to claim 8, wherein the adhesive layer is stuck to an outer surface of the window glass.

14. The vehicle according to claim 8, wherein the adhesive layer is stuck to an inner surface of the window glass.

* * * * *